US009652968B2

(12) United States Patent
Choi et al.

(10) Patent No.: US 9,652,968 B2
(45) Date of Patent: May 16, 2017

(54) CRADLE FOR EXHIBITING WEARABLE DEVICE AND METHOD FOR WARNING STOLEN STATE OF CRADLED WEARABLE DEVICE

(71) Applicant: Samsung Electronics Co., Ltd., Suwon-si, Gyeonggi-do (KR)

(72) Inventors: Sang-Wook Choi, Yongin-si (KR); Won-Suk Choi, Suwon-si (KR); Jong-Chul Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/580,633

(22) Filed: Dec. 23, 2014

(65) Prior Publication Data

US 2015/0243157 A1 Aug. 27, 2015

Related U.S. Application Data

(60) Provisional application No. 61/943,738, filed on Feb. 24, 2014.

(30) Foreign Application Priority Data

Sep. 4, 2014 (KR) ..... 10-2014-0117362

(51) Int. Cl.

| | |
|---|---|
| ***G08B 21/24*** | (2006.01) |
| ***E05B 73/00*** | (2006.01) |
| ***G08B 13/14*** | (2006.01) |

(52) U.S. Cl.

CPC ..... *G08B 21/24* (2013.01); *E05B 73/0005* (2013.01); *E05B 73/0082* (2013.01); *G08B 13/1463* (2013.01)

(58) Field of Classification Search

CPC . G08B 21/24; G08B 13/1463; E05B 73/0005; E05B 73/0082; Y10T 70/5004; Y10T 70/5009; Y10T 70/554; Y10T 70/5562; A47F 7/024; F16L 3/1033

See application file for complete search history.

(56) References Cited

U.S. PATENT DOCUMENTS

| | | | | |
|---|---|---|---|---|
| 5,512,880 A * | 4/1996 | Abrams | ..... | G08B 21/0208 340/539.1 |
| 6,192,722 B1 * | 2/2001 | Galant | ..... | E05B 73/0082 248/551 |
| 6,581,420 B1 * | 6/2003 | Ling | ..... | E05B 73/0082 248/551 |
| 6,711,921 B1 * | 3/2004 | Yang | ..... | E05B 73/0082 248/551 |

(Continued)

FOREIGN PATENT DOCUMENTS

| | | |
|---|---|---|
| KR | 20-0365731 Y1 | 10/2004 |
| KR | 10-2012-0116599 A | 10/2012 |

(Continued)

*Primary Examiner* — Sisay Yacob

(74) *Attorney, Agent, or Firm* — Jefferson IP Law, LLP

(57) ABSTRACT

A cradle having an anti-theft device of a wearable device is provided. The cradle includes a cradle body, a cradle head that supports a wearable device and is detachable from the cradle body, such that the cradle head is exchangeable, and an anti-theft device that connects the cradle body and the wearable device.

16 Claims, 18 Drawing Sheets

(56) References Cited

U.S. PATENT DOCUMENTS

| | | | | |
|---|---|---|---|---|
| 7,398,151 | B1 * | 7/2008 | Burrell | A63B 24/0062 342/357.75 |
| 2002/0145850 | A1 * | 10/2002 | Chang | B60R 11/02 361/679.41 |
| 2008/0165066 | A1 * | 7/2008 | Tiscareno | H01Q 1/242 343/702 |
| 2011/0080137 | A1 * | 4/2011 | Avganim | E05B 73/0082 320/115 |
| 2014/0263873 | A1 | 9/2014 | Kim | |

FOREIGN PATENT DOCUMENTS

| | | | |
|---|---|---|---|
| KR | 10-1209558 | B1 | 12/2012 |
| KR | 10-1303147 | B1 | 9/2013 |

* cited by examiner

CRADLE FOR EXHIBITING WEARABLE DEVICE AND METHOD FOR WARNING STOLEN STATE OF CRADLED WEARABLE DEVICE

CROSS-REFERENCE TO RELATED APPLICATION(S)

This application claims the benefit under 35 U.S.C. §119 (e) of a U.S. Provisional application filed on Feb. 24, 2014 in the U.S. Patent and Trademark Office and assigned Ser. No. 61/943,738, and under 35 U.S.C. §119(a) of a Korean patent application filed on Sep. 4, 2014 in the Korean Intellectual Property Office and assigned Serial number 10-2014-0117362, the entire disclosure of each of which is hereby incorporated by reference.

TECHNICAL FIELD

The present disclosure relates to a cradle. More particularly, the present disclosure relates to a cradle having an anti-theft device of a wearable device.

BACKGROUND

A cradle may include a support body using a support that holds a mobile terminal so that the mobile terminal does not move in order to charge the mobile terminal or a support that holds an inclined state of the mobile terminal in order to view the mobile terminal.

Further, the cradle may be a support that is used for charging a battery as well as the mobile terminal. Such a cradle may be a portable cradle which a user carries, a desk-top-type cradle for use on a table, and a cradle for a vehicle that is installed within the vehicle to support a mobile terminal.

Further, the cradle may be for displaying a mobile terminal at an exhibition or a general mobile terminal retail store.

As a method of supporting the mobile terminal by the cradle, the mobile terminal is fixed to the cradle using a fastening device, such as a screw.

However, this method of supporting the mobile terminal has a problem in that, when the mobile terminal is a wearable device, such as a device that is worn on a wrist, it is impossible for a user to wear the support or the cradle on their wrist and the user cannot determine a function and design of a rear surface of the mobile terminal.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a cradle having an anti-theft function when exhibiting a wearable device.

Another aspect of the present disclosure is to provide a cradle and a method for providing a warning of a stolen state of a cradled wearable device so as to provide a notification of the stolen state when exhibiting the cradled wearable device.

Another aspect of the present disclosure is to provide a cradle and a method of providing a warning of a stolen state of a cradled wearable device that can replace a cradle head and that can be used in various wearable devices by enabling a cradle body to use for common use.

Another aspect of the present disclosure is to provide a cradle and a method of providing a warning of a stolen state of a cradled wearable device that can prevent theft by connecting the wearable device and a band strap using a separate frame in the wearable device in which a main body and the band strap are separated.

Another aspect of the present disclosure is to provide a cradle and a method of providing a warning of a stolen state of a cradled wearable device that can occur when a theft occurs in an exhibition.

Another aspect of the present disclosure is to provide a cradle and a method of providing a warning of a stolen state of a cradled wearable device that can visually notify the stolen state or a charge state using mounted Light Emitting Diodes (LEDs) in a band lock fixed to a band strap.

In accordance with an aspect of the present disclosure, a cradle is provided. The cradle includes a cradle body, a cradle head that supports a wearable device and is detachable from the cradle body, such that the cradle head is exchangeable, and an anti-theft device that connects the cradle body and the wearable device.

In accordance with another aspect of the present disclosure, a method of notifying a stolen state of a cradled wearable device of a cradle is provided, wherein the cradle includes a wearable device including a main body and a band strap coupled to the main body, a cradle body that supports the wearable device, a band lock fixed to the band strap, a switch mounted in the band lock, and a security cable that connects the cradle body and the band lock. Further, the method includes mounting the band lock in the band strap, setting a security mode with an operation of the switch mounted in the band lock, determining whether the wearable device is stolen by determining a stolen state of the wearable device based on the operation of the switch, and visually or audibly notifying the stolen state of the wearable device, when the stolen state is determined.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
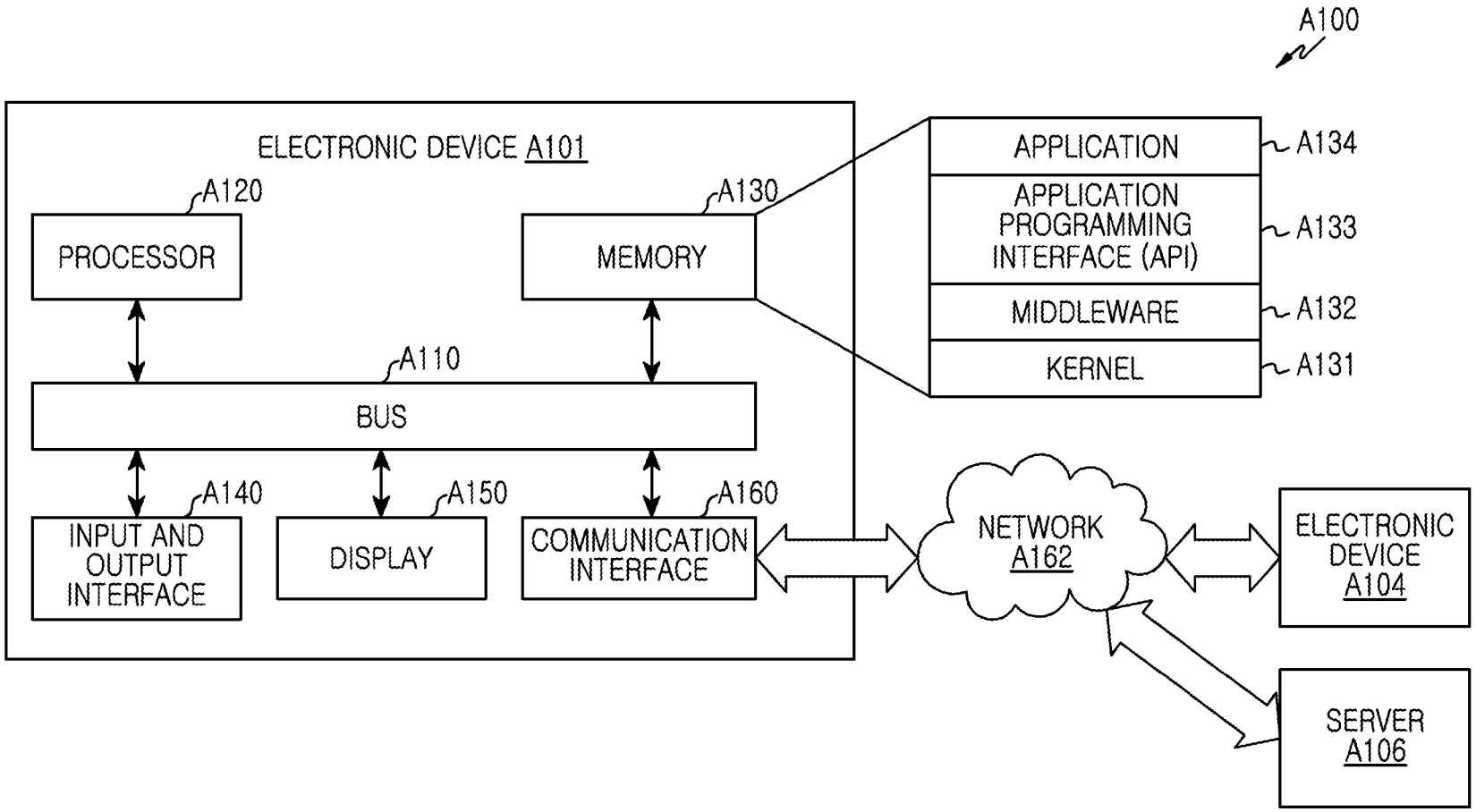
FIG. 1 is a diagram illustrating a network environment including an electronic device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

When describing the present disclosure, the term "substantially" represents that it is unnecessary that a quoted characteristic, parameter, or value is accurately achieved, an allowable error, a measurement error, a measurement accuracy limit, and a deviation, a change, or a characteristic including other elements known to a person of ordinary skill in the art may occur not to exclude an effect to provide.

While the present disclosure may be embodied in many different forms, various specific embodiments of the present disclosure are shown in drawings and are described herein in detail, with the understanding that the present disclosure is to be considered as an exemplification of the principles of the disclosure and is not intended to limit the disclosure to the various specific embodiments illustrated therein. While the present disclosure may be embodied in many different forms, various specific embodiments of the present disclosure are shown in drawings and are described herein in detail, with the understanding that the present disclosure is to be considered as an exemplification of the principles of the disclosure and is not intended to limit the disclosure to the various specific embodiments illustrated therein. The same reference numbers are used throughout the drawings to refer to the same or like parts.

An expression "comprising" or "may comprise" used in the present disclosure indicates presence of a corresponding function, operation, or element and does not limit additional at least one function, operation, or element. Further, in the present disclosure, a term "comprise" or "have" indicates the presence of a characteristic, numeral, step, operation, element, component, or combination thereof described in the specification and does not exclude the presence or the addition of at least one other characteristic, numeral, step, operation, element, component, or combination thereof.

In the present disclosure, an expression "or" includes any combination or the entire combination of together listed words. For example, "A or B" may include A, B, or A and B.

In the present disclosure, expressions such as "first," "second," "primary," and "secondary" may modify various constituent elements of the present disclosure, but do not limit corresponding constituent elements. For example, the expressions do not limit order and/or importance of corresponding elements. The expressions may be used for distinguishing one element from another element. For example, both a first user device and a second user device are user devices and represent different user devices. For example, a first constituent element may be referred to as a second constituent element without deviating from the scope of the present disclosure, and similarly, a second constituent element may be referred to as a first constituent element.

When it is described that an element is "coupled" to another element, the element may be "directly coupled" to the other element or "electrically coupled" to the other element through a third element. However, when it is described that an element is "directly coupled" to another element, no element may exist between the element and the other element.

Terms used in the present disclosure are not to limit the present disclosure but are to illustrate embodiments. When used in a description of the present disclosure and the appended claims, a singular form includes a plurality of forms unless it is explicitly differently represented.

Unless differently defined, entire terms including a technical term and a scientific term used here have the same meaning as a meaning that may be generally understood by a person of common skill in the art. It should be analyzed that generally using terms defined in a dictionary have a meaning corresponding with that of a context of related technology and are not analyzed as an ideal or excessively formal meaning unless explicitly defined.

An electronic device according to the present disclosure may be a mobile device including a communication function. For example, the electronic device may include at least one of a smart phone, tablet Personal Computer (PC), mobile phone, video phone, e-book reader, desktop PC, laptop PC, netbook computer, Personal Digital Assistant (PDA), Portable Multimedia Player (PMP), MPEG 3 (MP3) player, mobile medical equipment, camera, or wearable device (e.g., a Head-Mounted-Device (HMD) such as electronic glasses, electronic clothing, electronic bracelet, electronic necklace, electronic accessory, electronic tattoo, or smart watch).

According to various embodiments of the present disclosure, the electronic device may be a smart home appliance having a communication function. The smart home appliance, for example, the electronic device may include at least one of a television, Digital Versatile Disk (DVD) player, audio device, refrigerator, air conditioner, vacuum cleaner, oven, microwave oven, washing machine, air cleaner, set-top box, television box (e.g., a Samsung HomeSync™, AppleTV™, or Google TV™), game consoles, electronic dictionary, electronic key, camcorder, or electronic frame.

According to various embodiments of the present disclosure, the electronic device may include at least one of various medical equipment (e.g., a Magnetic Resonance Angiography (MRA) device, a Magnetic Resonance Imaging (MRI) device, a Computed Tomography (CT) device, a scanning device, and a ultrasonic wave device), a navigation device, a Global Positioning System (GPS) receiver, an Event Data Recorder (EDR), a Flight Data Recorder (FDR), a vehicle infotainment device, an electronic equipment for ship (e.g., a navigation device for ship and gyro compass), avionics, a security device, or an industrial or home robot.

According to various embodiments of the present disclosure, the electronic device may include at least one of a portion of furniture or building/construction, an electronic board, an electronic signature receiving device, a projector, or various measuring devices (e.g., devices for measuring water supply, electricity, gas, or an electric wave) including a communication function. An electronic device according to the present disclosure may be at least one combination of the foregoing various devices. Further, an electronic device according to the present disclosure is not limited to the foregoing devices.

Hereinafter, an electronic device according to various embodiments of the present disclosure will be described with reference to the accompanying drawings. A term of a user used in various embodiments of the present disclosure may indicate a person using an electronic device or a device (e.g., an artificial intelligence electronic device) using the electronic device.

FIGS. 1 through 16, discussed below, and the various embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the present disclosure. Terms first, second, and the like are used to differentiate between objects having the same terminology and are in no way intended to represent a chronological order, unless where explicitly stated otherwise. A set is defined as a non-empty set including at least one element.

FIG. 1 is a diagram illustrating a network environment including an electronic device according to an embodiment of the present disclosure.

Referring to FIG. 1, a network environment A100 including an electronic device A101 is illustrated, where the electronic device A101 may include a bus A110, a processor A120, a memory A130, an input and output interface A140, a display A150, a communication interface A160, and a sensor module (not shown).

The bus A110 may be a circuit that connects the foregoing constituent elements and that transmits a communication signal (e.g., a control message) between the foregoing constituent elements.

The processor A120 may receive an instruction from the foregoing other constituent elements (e.g., the memory A130, the input and output interface A140, the display A150, the communication interface A160, or the sensor module (not shown)) through, for example, the bus A110, decode the received instruction, and perform operation and data processing according to the decoded instruction.

The memory A130 may store an instruction or data received from the processor A120 or other constituent elements (e.g., the input and output interface A140, the display A150, the communication interface A160, or the sensor module (not shown)) or generated by the processor A120 or other constituent elements. The memory A130 may include a programming module such as a kernel A131, middleware A132, an Application Programming Interface (API) A133, or an application A134. The foregoing respective programming modules may be formed with software, firmware, hardware, or a combination of at least two thereof.

The kernel A131 may control or manage a system resource (e.g., the bus A110, the processor A120, or the memory A130) used for executing an operation or a function implemented in the remaining programming modules, for example, the middleware A132, the API A133, or the application A134. Further, the kernel A131 may provide an interface that can access an individual constituent element of the electronic device A101 in the middleware A132, the API A133, or the application A134 to control or manage the individual constituent element.

The middleware A132 may perform an intermediary function of enabling the API A133 or the application A134 to communicate with the kernel A131 to send and receive data. Further, the middleware A132 may control (e.g., a schedule or load balance) a work request received from the application A134 using, for example, a method of aligning a priority that can use a system resource (e.g., the bus A110, the processor A120, or the memory A130) of the electronic device A101 to at least one of the applications A134.

The API A133 is an interface that enables the application A134 to control a function in which the kernel A131 or the middleware A132 provides and may include, for example, at least one interface or function (e.g., an instruction) for file control, window control, image processing, or text control.

According to various embodiments of the present disclosure, the application A134 may include a Short Message Service (SMS)/Multimedia Message Service (MMS) application, an e-mail application, a calendar application, an alarm application, a health care application (e.g., an application that measures an exercise amount or blood sugar), or an environment information application (e.g., an application that provides atmospheric pressure, humidity, or temperature information). Additionally or alternatively, the application A134 may be an application related to an information exchange between the electronic device A101 and an external electronic device (e.g., a server A106 or an electronic device A104). The application related to information exchange may include, for example, a notification relay application that transmits specific information to the external electronic device or a device management application that manages the external electronic device.

For example, the notification relay application may include a function of transmitting notification information that has occurred in other applications (e.g., an SMS/MMS application, an e-mail application, a health care application, or an environment information application) of the electronic device A101 to an external electronic device (e.g., the server A106 or the electronic device A104). Additionally or alternatively, for example, the notification relay application may receive notification information from an external electronic device (e.g., the server A106 or the electronic device A104) and provide the notification information to a user. For example, the device management application may manage (e.g., install, delete, or update) a turn-on/turn-off of a function of at least a portion of an external electronic device (e.g., the server A106 or the electronic device A104) that communicates with the electronic device A101 or a brightness (or resolution adjustment) of a display, an application operating in an external electronic device, or a service (e.g., a communication service or a message service) provided in an external electronic device.

According to various embodiments of the present disclosure, the application A134 may include an application designated according to an attribute (e.g., a kind of an electronic device) of an external electronic device (e.g., the server A106 or the electronic device A104). For example, when the external electronic device is an MP3 player, the application A134 may include an application related to music reproduction. Similarly, when the external electronic device is a mobile medical device, the application A134 may include an application related to health care. According to an embodiment of the present disclosure, the application A134 may include at least one of an application designated to the electronic device A101 or an application received from an external electronic device (e.g., the server A106, or the electronic device A104).

The input and output interface A140 may transfer a command or data input by a user through a sensor (e.g., an acceleration sensor or a gyro sensor) or an input device (e.g., a keyboard or a touch screen), for example, to the processor A120, the memory A130, and the communication interface A160 through the bus A110. For example, the input and output interface A140 may provide data about a user touch input through a touch screen to the processor A120. Further, the input and output interface A140 may output an instruction or data received from the processor A120, the memory A130, the communication interface A160, or the sensor module (not shown) through, for example, the bus A110, through the output device (e.g., a speaker or a display). For example, the input and output interface A140 may output sound data processed through the processor A120 to the user through a speaker.

The display A150 may display various information (e.g., multimedia data or text data) to the user.

The communication interface A160 may provide communication between the electronic device A101 and an external device (e.g., the electronic device A104, or the server A106). For example, the communication interface A160 may support a communication of a network A162 (e.g., Internet, Local Area Network (LAN), Wide Area Network (WAN), telecommunication network, cellular network, satellite network, or Plain Old Telephone Service (POTS)), short range communication (not shown), such as Wireless Fidelity (WiFi), Bluetooth (BT), or Near Field Communication (NFC), or wired communication, such as Universal Serial Bus (USB), High Definition Multimedia Interface (HDMI), Recommended Standard (RS)-232, or POTS). According to an embodiment of the present disclosure, a protocol for communication between the electronic device A101 and an external device (e.g., a short range communication protocol, a network communication protocol, or a wire communication protocol) may be supported in at least one of the API A133 or the middleware A132. The electronic device A104 may be the same device (e.g. the same type) as the electronic device A101 or may be different (e.g., different type) from the electronic device A101.

The sensor module (not shown) may measure a physical quantity or detect an operation state of an electronic device and convert measured or detected information to an electronic signal. The sensor module (not shown) may include, for example, at least one of a gesture sensor, a gyro sensor, an atmospheric pressure sensor, a magnetic sensor, an acceleration sensor, a grip sensor, a proximity sensor, a color sensor (e.g., a Red, Green, and Blue (RGB) sensor), a bio sensor, a temperature/humidity sensor, an illumination sensor, or a Ultra Violet (UV) sensor. Additionally, the sensor module (not shown) may include, for example, an E-nose sensor, an electromyography sensor (EMG sensor), an electroencephalogram sensor (EEG sensor), an electrocardiogram sensor (ECG sensor), an Infrared (IR) sensor, an iris recognition sensor, or a fingerprint recognition sensor.

A configuration of a cradle according to various embodiments of the present disclosure will be described with reference to FIGS. 2 to 4.

Figure 2:
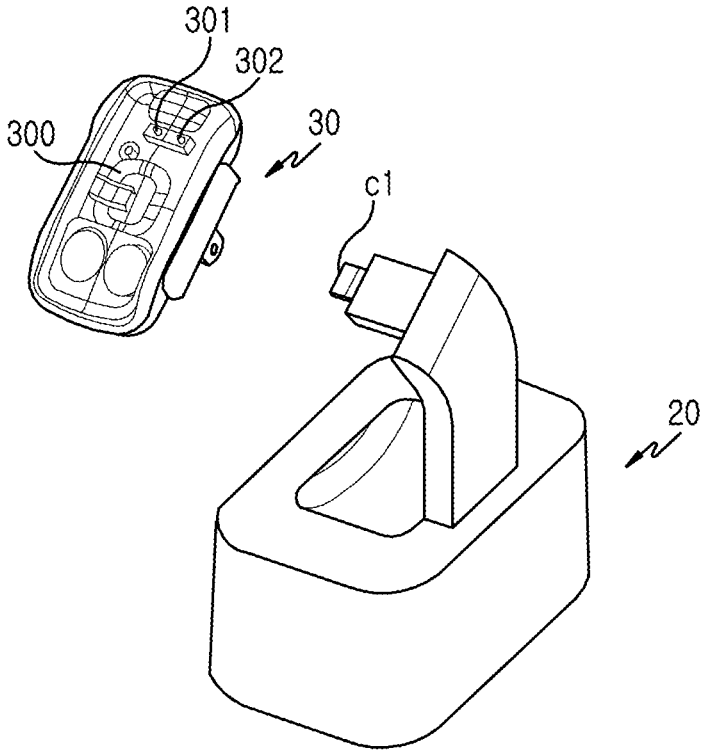
FIG. 2 is a perspective view illustrating a state in which a cradle head is separated from a cradle body according to an embodiment of the present disclosure.
Figure 3:
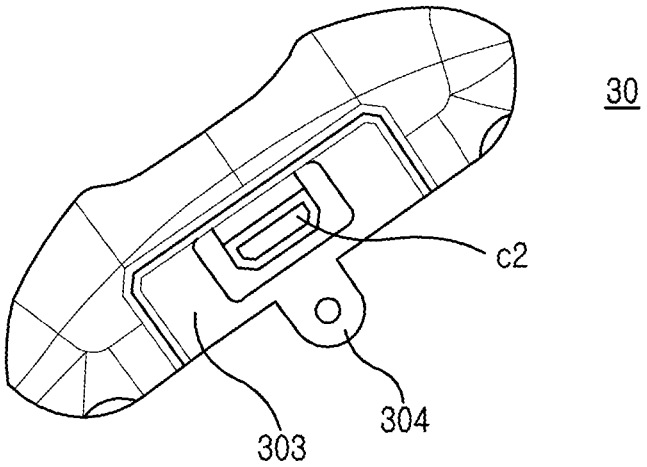
FIG. 3 is a side view illustrating a cradle head according to an embodiment of the present disclosure.
Figure 4:
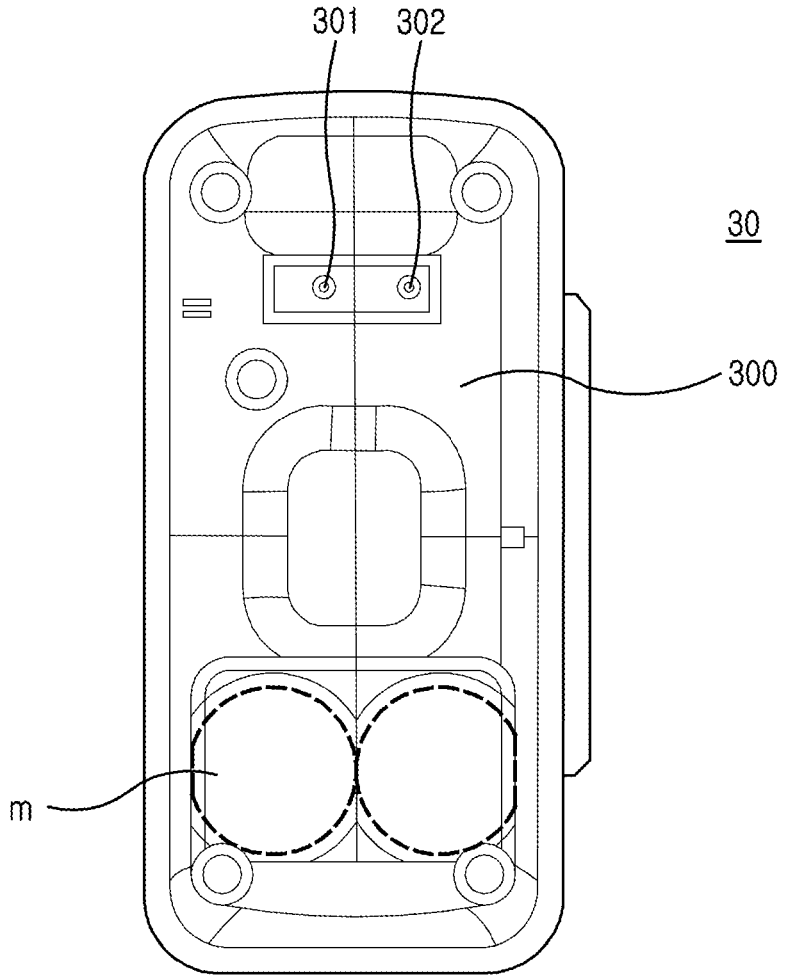
FIG. 4 is a front view illustrating a cradle head according to an embodiment of the present disclosure.

FIG. 2 is a perspective view illustrating a state in which a cradle head is separated from a cradle body according to an embodiment of the present disclosure, FIG. 3 is a side view illustrating a cradle head according to an embodiment of the present disclosure, and FIG. 4 is a front view illustrating a cradle head according to an embodiment of the present disclosure.

Referring to FIGS. 2 to 4, a cradle according to various embodiments of the present disclosure may be a cradle for exhibiting/displaying a mobile terminal to reporters or users at an exhibition, a mobile terminal retail store, and other public locations.

Particularly, a cradle according to various embodiments of the present disclosure may be formed as a cradle that supports a wearable device that can be worn on a wrist. The cradle may include a cradle body, a cradle head, and an anti-theft device. First, a configuration of the cradle body and the cradle head will be described, and a detailed description of the anti-theft device will be described later.

The cradle may include a cradle body 20 and a cradle head 30 to be detached from the cradle body 20. The cradle body 20 is a cradle base and may be placed on a desk-top table of a horizontal state or in a wall of a vertical state. Alternatively, the cradle body 20 may be fixed to an inclined plane. The cradle body 20 may house a main board (not shown) and a control box (not shown) therein.

The cradle head 30 may be mechanically coupled to the cradle body 20 or may be separated from the cradle body 20. Further, the cradle head 30 is electrically connected to the cradle body 20 or the cradle head 30 may be disconnected from the cradle body 20. The cradle head 30 may contain a wireless charging pad. The cradle head 30 and the cradle body 20 may be physically detached and may be electrically connected by connecting portions C1 and C2. That is, the connecting portions C1 and C2 may have a detaching function in addition to a connection function. Further, for example, when a changeable head connection does not fit into a head connection in the cradle body 20, it can be connected to the cradle body 20 after a separate adaptor or connector is connected to the changeable head (e.g., the cradle head 30).

The connecting portion may include a male-type connecting portion and a female-type connecting portion. The male-type connecting portion may be mounted in the cradle body 20 or the cradle head 30. When the male-type connecting portion C1 is mounted in the cradle body 20, the female-type connecting portion C2 may be mounted in the cradle head 30. FIG. 2 illustrates that the male-type connecting portion C1 is mounted in the cradle body 20. According to various embodiments of the present disclosure, the connecting portions C1 and/or C2 may include, for example, a USB connector, a micro USB, and a pogo pin. At the cradle body 20, the male-type USB connector C1 may be formed, and at the cradle head 30, the female-type USB connector C2 may be formed. When the two type USB connectors are connected, the cradle head 30 may be electrically connected to the cradle body 20 when coupled to the cradle body 20.

An upper surface 300 of the cradle head 30 may be an area that supports the wearable device, and one side surface thereof may be an area in which the USB connector C2 is formed. Further, at the one side surface, a fastening portion 303 for coupling to the cradle body 20 may be formed.

Referring to FIG. 3, the fastening portion 303 may be fixed at one side surface of the cradle head 30. Further, another fastening portion corresponding to the fastening portion 303 may be provided in the cradle body. In the fastening portion 303, a fastening terminal 304 having a fastening hole may be provided. Further, in a central area of the fastening portion 303, the female type USB connector C2 may be formed.

Referring to FIG. 4, the upper surface 300 of the cradle head 30 may be an area that supports the wearable device. When the wearable device is placed, charge contact terminals 301 and 302 connecting to a charge contact terminal (not shown) of the wearable device may be disposed at the upper surface 300. At least two charge contact terminals 301 and 302 may be formed. The charge contact terminals 301 and 302 may be formed, for example, in a pogo pin. The charge contact terminals 301 and 302 are disposed in a shape protruded from the upper surface 300 and may be a terminal having elasticity that is compressed when pressing and that returns to an original position, when a pressing force is removed, like a spring. Further, although not shown, at a rear surface of the wearable device, a pad type charge terminal corresponding to the charge contact terminals 301 and 302 may be disposed to be exposed.

Referring again to FIG. 2, a direction in which the cradle head 30 is detached from the cradle body 20 is not limited. In order words, FIG. 2 illustrates a structure in which the cradle head 30 is detached to be slightly inclined from the cradle body 20, but the cradle head 30 may be detachably formed from the cradle body 20 in a horizontal state and may be detachably formed from the cradle body 20 in a vertical state.

Further, a holding device may be provided between the cradle head 30 and the wearable device. The holding device may provide a force for attaching the wearable device to the cradle head 30. The holding device may include a magnetic body m (shown in FIG. 4) provided in the cradle body and a metal material portion at a rear surface of the wearable device. The metal material portion may be formed by coating a portion or the entire of a rear surface of the wearable device with a metal material or by attaching a metal material to a portion or the entire of a rear surface of the wearable device, and a rear case of the wearable device may be made of a metal material. Alternatively, in a portion of a rear surface of the wearable device, a magnetic body may be provided.

A configuration of an anti-theft device of a supported wearable device according to various embodiments of the present disclosure will be described with reference to FIGS. 5 and. 6.

Figure 5:
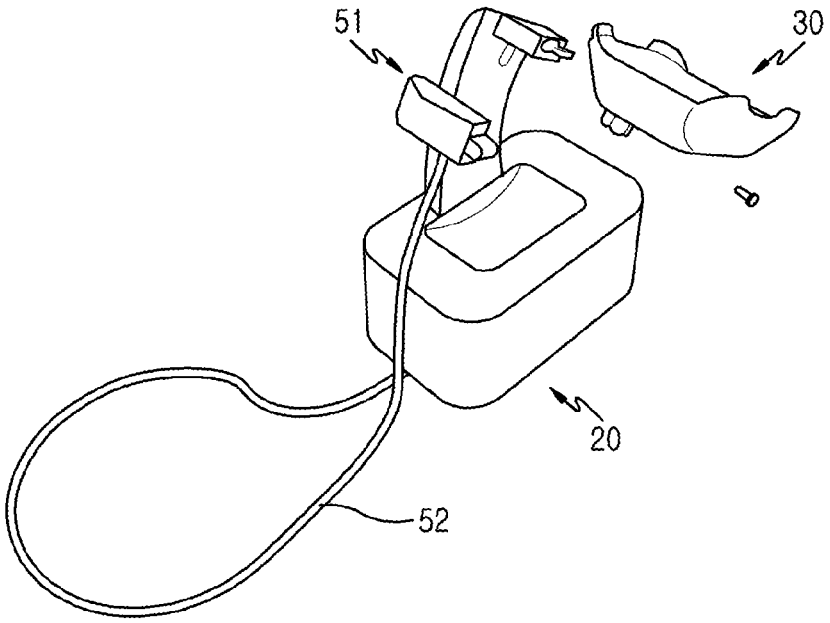
FIG. 5 is a perspective view illustrating a cradle having an anti-theft device according to an embodiment of the present disclosure.
Figure 6:
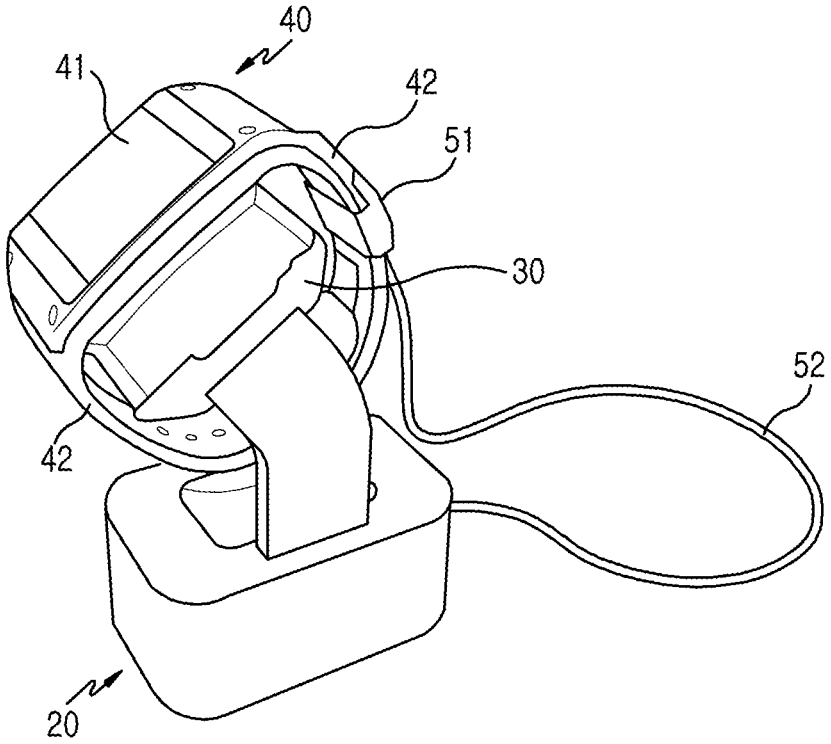
FIG. 6 is a perspective view illustrating a state in which a wearable device is placed in a cradle having an anti-theft device according to an embodiment of the present disclosure.

FIG. 5 is a perspective view illustrating a cradle having an anti-theft device according to an embodiment of the present disclosure, and FIG. 6 is a perspective view illustrating a state in which a wearable device is placed in a cradle having an anti-theft device according to an embodiment of the present disclosure.

Referring to FIGS. 5 and 6, a wearable device 40 may include a main body 41 and a band strap 42. At an upper surface of the main body 41, a display is disposed, and at the center of two band straps 42, the main body 41 may be fixed in an integral form. The band strap 42 may enable a user to wear the main body 41 on their wrist. The wearable device 40 may be formed in a wrist wearing mobile terminal.

An anti-theft device of the wearable device 40 according to various embodiments of the present disclosure may include a band lock 51 and a security cable 52. The band lock 51 may be fixed to one band strap 42 of the two band straps 42. A fixed structure of the band lock 51 will be described later. The security cable 52 may be formed in a helical shape to be extended. One end of the security cable 52 may be connected to a cradle body 20, and the other end thereof may be connected to the band lock 51. Further, the security cable 52 may electrically connect the band lock 51 to the cradle body 20. That is, the security cable 52 may perform two functions of mechanically connecting and electrically connecting the band lock 51 and the cradle body 20.

Referring to FIG. 6, according to various embodiments of the present disclosure, in a state in which the wearable device 40 is connected to an anti-theft device, a state before the wearable device 40 is supported by a cradle head 30 is illustrated. At an upper surface of the cradle head 30 coupled to the cradle body 20, the main body 41 is supported. Further, the wearable device 40 can be prevented from being stolen by the band lock 51 and the security cable 52.

Figure 7A:
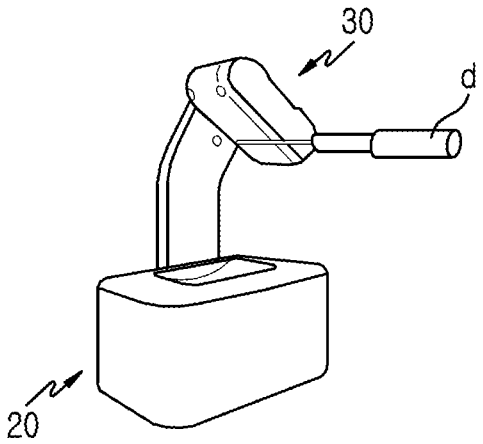
FIGS. 7A and 7B are perspective views illustrating a state in which a cradle head is fastened to a cradle body according to various embodiments of the present disclosure.
Figure 7B:
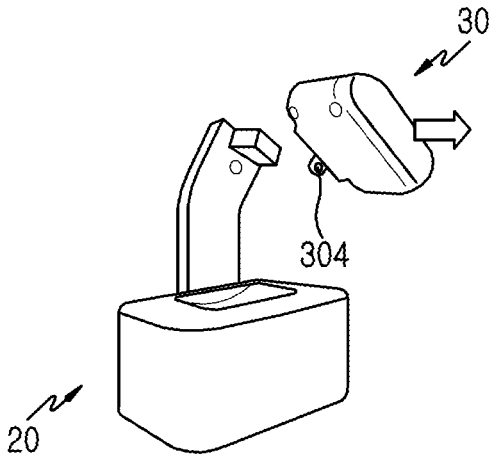

FIGS. 7A and 7B are perspective views illustrating a state in which a cradle head is fastened to a cradle body according to various embodiments of the present disclosure.

Referring to FIGS. 7A and 7B, a cradle head 30 may be mounted in a cradle body 20 using a fastening device. In the fastening device, for example, a screw may be fastened to a fastening portion provided in each of the cradle body 20 and the cradle head 30 using a driver d. As described above, a coupling position of the cradle head may be primarily determined and be coupled to the cradle body by a connecting portion and the cradle head may be secondarily coupled to the cradle body by a fastening end portion 304 of the fastening portion.

Figure 8:
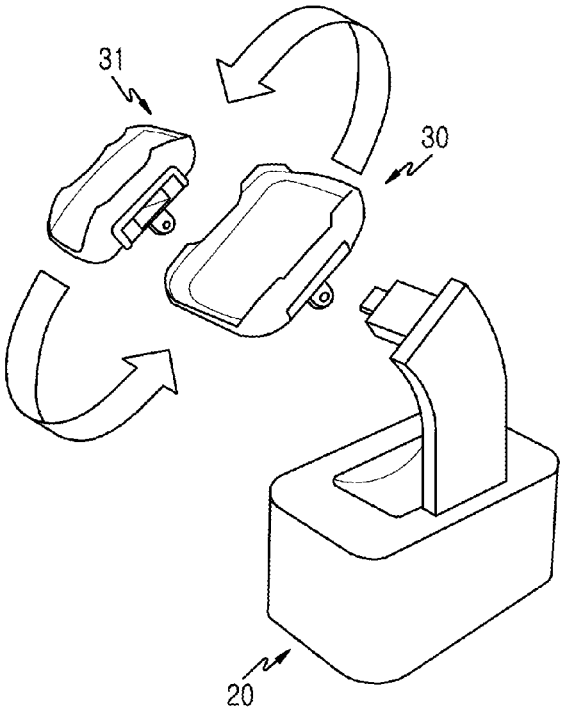
FIG. 8 is a perspective view illustrating a state that exchanges a cradle head and that places a wearable device in a cradle body according to an embodiment of the present disclosure.

FIG. 8 is a perspective view illustrating a state that exchanges a cradle head and that places a wearable device in a cradle body according to an embodiment of the present disclosure.

Referring to FIG. 8, a cradle head of a cradle, according to various embodiments of the present disclosure, may be detachably formed from a cradle body 20. Therefore, the cradle head may be exchanged, and the cradle body may be formed for common use. FIG. 8 illustrates two of first and second cradle heads 30 and 31. The first cradle head 30 may be a cradle that supports a first wearable device, and the second cradle head 31 may be a cradle that supports a second wearable device. In the first and second cradle heads 30 and 31, a configuration of a connecting portion or a fastening portion is the same, a support portion may be differently formed to correspond to an external shape of the first and second wearable devices. A user may selectively use the first and second cradle heads 30 and 31, as needed.

A configuration of an anti-theft device of a supported wearable device according to various embodiments of the present disclosure will be described with reference to FIGS. 9 and 10.

Figure 9:
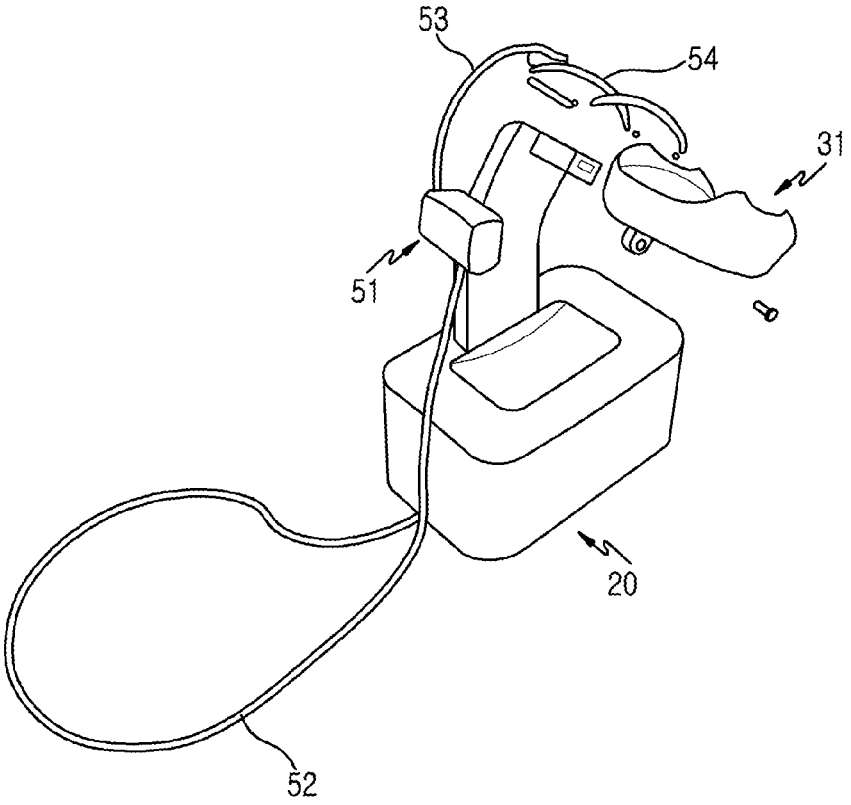
FIG. 9 is a perspective view illustrating a state in which a wearable device is placed in a cradle having an anti-theft device according to an embodiment of the present disclosure.
Figure 10:
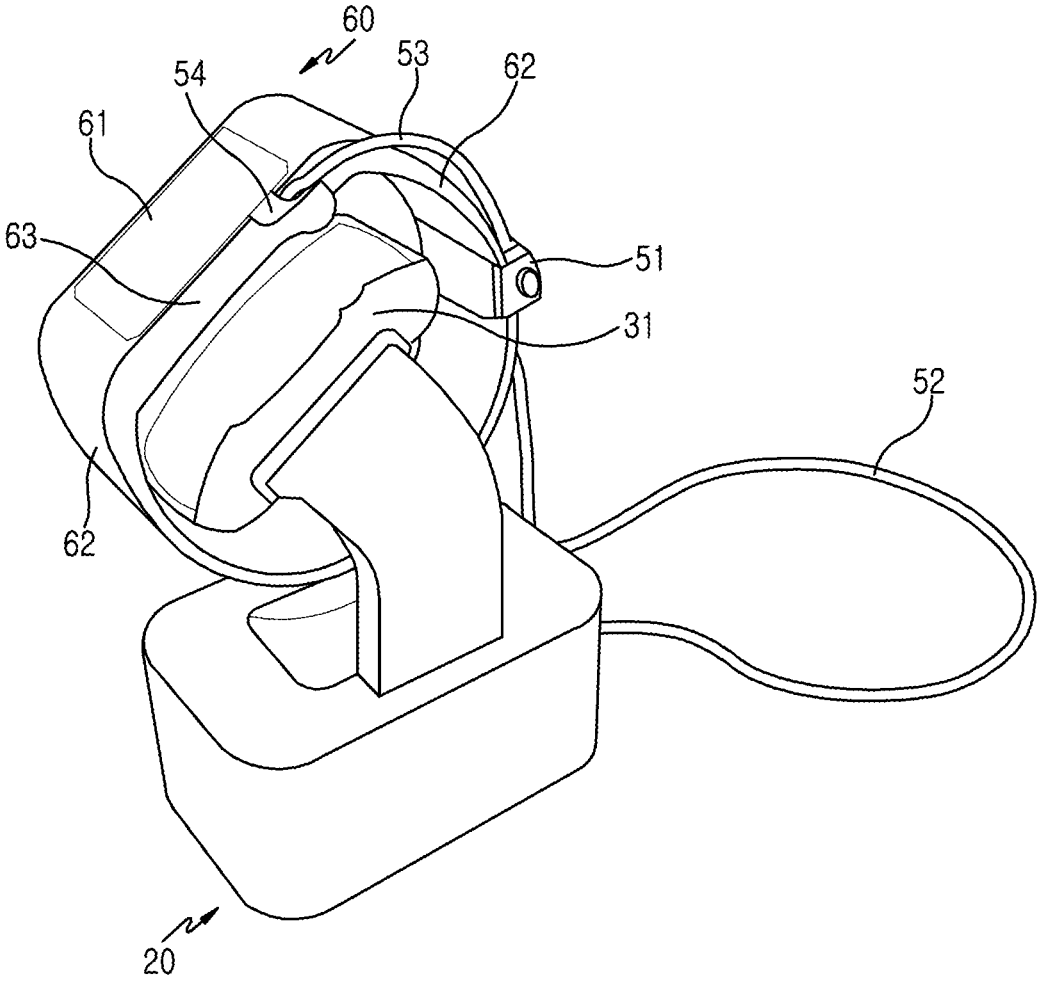
FIG. 10 is a perspective view illustrating a state immediately before a wearable device is placed in a cradle according to an embodiment of the present disclosure.

FIG. 9 is a perspective view illustrating a state in which a wearable device is placed in a display cradle having an anti-theft device according to an embodiment of the present disclosure, and FIG. 10 is a perspective view illustrating a state immediately before a wearable device is placed in a cradle according to an embodiment of the present disclosure.

Referring to FIGS. 9 and 10, according to various embodiments of the present disclosure, a wearable device 60 may include a main body 61 and a band strap 62. The main body 61 may be coupled to a receiving portion 63 of the band strap 62 or may be separated from the receiving portion 63 of the band strap 62. The band strap 62 may enable a user to wear the main body 61 on their wrist. The wearable device 60 may be formed in a wrist wearing mobile terminal. Further, the band strap 62 may be made of a flexible material having elasticity to forcedly couple the main body 61 to the receiving portion 63 or separate the main body 61 from the receiving portion 63.

An anti-theft device of the wearable device 60 according to various embodiments of the present disclosure may include a band lock 51, a security cable 52, and a wire 53. The band lock 51 may be fixed to one band strap 62 of two band straps 62. A fixing structure of the band lock 51 will be described later. The security cable 52 may be formed in a helical shape to be elastically extended. One end of the security cable 52 is connected to a cradle body 20, and the other end thereof is connected to the band lock 51. Further, the security cable 52 may electrically connect the band lock 51 to the cradle body 20. That is, the security cable 52 may perform two functions of mechanically connecting and electrically connecting the band lock 51 and the cradle body 20. The wire 53 may connect the main body 61 and the band lock 51. One end of the wire 53 may be fixed to the band lock 51, and the other end thereof may be fixed to the main body, specifically, to a band type bracket 54 fixed to enclose a side surface of the main body. Even if the main body 61 is separated from the band strap 62 by the wire 53, the main body 61 is locked by the band lock 51 and thus the wearable device can be prevented from being stolen. Both ends of the band type bracket 54 may be fixed to the other end of the wire 53.

The main body 61 may be received in a cradle head 31, the wearable device 60 may be locked to the band lock 51 by the wire 53, and the security cable 52 may electrically connect the band lock 51 and the cradle body 20.

A configuration of the band lock 51 according to various embodiments of the present disclosure will be described with reference to FIGS. 11 and 12.

Figure 11:
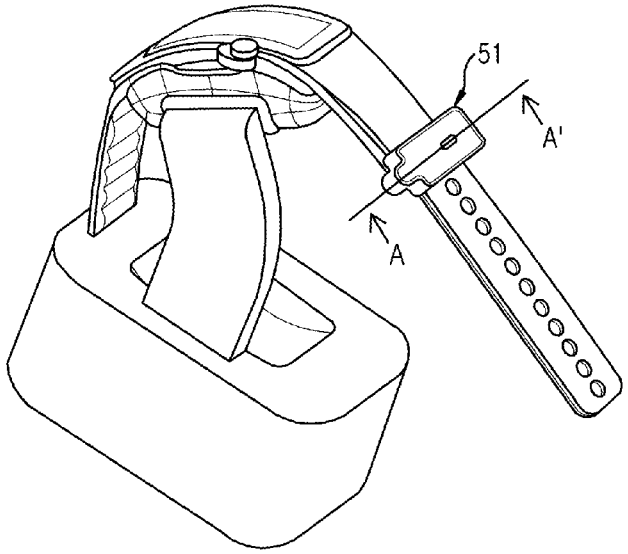
FIG. 11 is a perspective view illustrating a state in which a band lock is mounted in a band strap of a wearable device according to an embodiment of the present disclosure.
Figure 12:
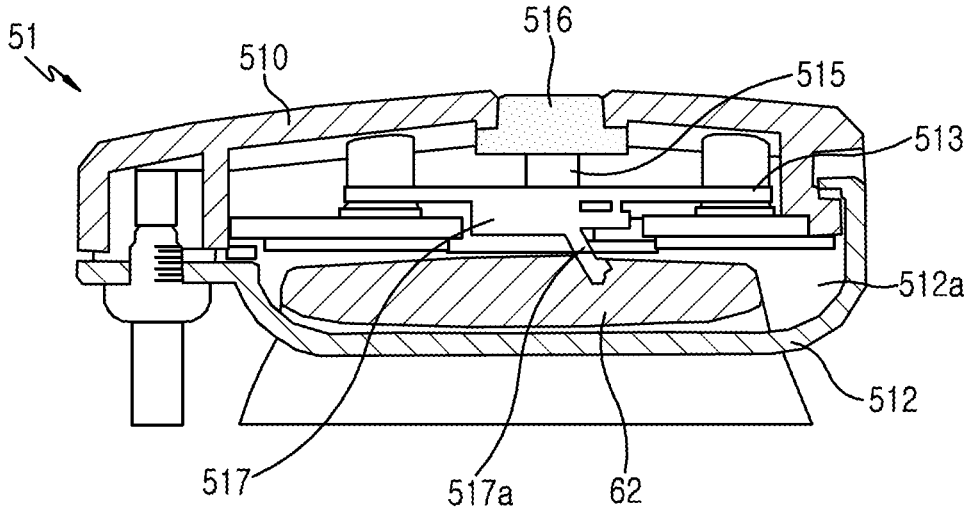
FIG. 12 is a cross-sectional view illustrating a state taken along line A-A' of FIG. 11 according to an embodiment of the present disclosure.

FIG. 11 is a perspective view illustrating a state in which a band lock is mounted in a band strap of a wearable device according to an embodiment of the present disclosure, and FIG. 12 is a cross-sectional view illustrating a state taken along line A-A' of FIG. 11 according to an embodiment of the present disclosure.

Referring to FIGS. 11 and 12, a band lock 51 according to various embodiments of the present disclosure may include a band lock body 510 and a band lock cover 512. The band lock 51 may form an external appearance with coupling of the band lock body 510 and the band lock cover 512 and may be fixed to a band strap 62. The coupling structure may use a fastening device such as a screw or may use a latch structure such as a hook.

The band lock 51 may include a substrate 513, an optical element 515, and a switch 517. At an upper surface of the substrate 513, the optical element 515, for example, a Light Emitting Diode (LED), may be disposed, and at a lower surface thereof, the switch 517 may be disposed. In the band lock body 510 facing the LED 515, a light waveguide 516 may be disposed. The light waveguide 516 may be made of a transparent or translucent synthesis resin. Light emitted from the LED 515 by the light waveguide 516 may be emitted to the outside of the band lock body 510.

The switch 517 may be disposed at a lower surface of the substrate, and an end portion of an actuator **517*a* thereof may be disposed at a bottom surface of the band lock body 510. When the band lock body 510 and the band lock cover 512 are coupled, a space 512*a* for inserting the band strap 62 may exist between a bottom surface of the band lock body 510 and an inner surface of the band lock cover 512. When the band strap does not exist, an end portion of the actuator 517*a* may be disposed to protrude into the space 512*a*. The switch 517 is a component for notifying a stolen state of the wearable device, and as the band strap 62 is inserted into the space 512*a*, when the switch 517 is pressed by the inserted band strap 62, the switch 517** is in an on-state and may be in a security mode in a non-stolen state.

However, as the coupling of the band lock body 510 and the band lock cover 512 is released, when an end portion of the actuator **517*a* is in a protruded state that is not pressed by the band strap 62, the switch 517 is turned off to notify the control box provided in the cradle body of a stolen state. A process of notifying a stolen state by operation of the switch 517**, i.e., an on/off operation will be described later.

The switch 517 may be replaced with a sensor. When the sensor is mounted, it may be notified whether the band strap 62 exists by detection of the sensor, and a stolen state of the wearable device may be finally determined.

The band lock body 510 is a portion to which one end of the security cable is fixed.

Further, according to various embodiments of the present disclosure, the LED 515 of the band lock 51 may notify a charge state as well as a stolen state. When the LED 515 emits light, the LED 515 may visually notify that the wearable device is in a charge state.

A method of mounting the band lock 51 according to various embodiments of the present disclosure will be described with reference to FIGS. 13A to 13C.

Figure 13A:
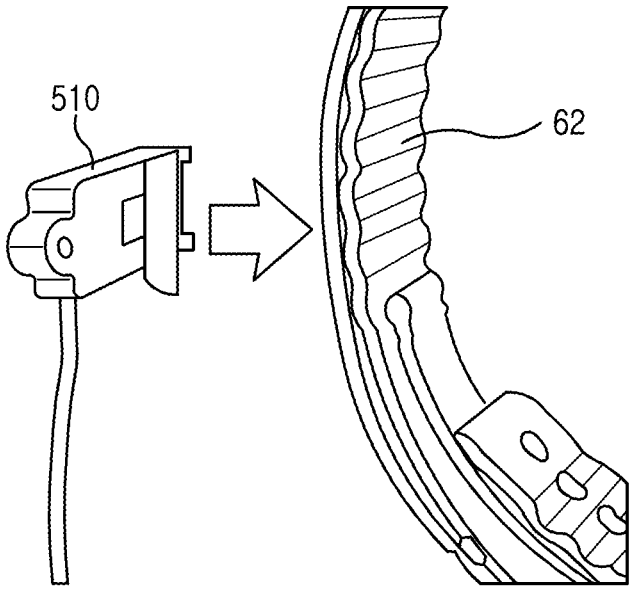
FIGS. 13A, 13B, and 13C are perspective views sequentially illustrating a process of mounting a band lock in a band strap according to various embodiments of the present disclosure.
Figure 13B:
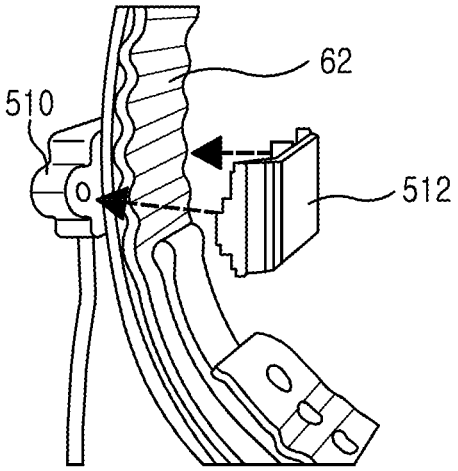
Figure 13C:
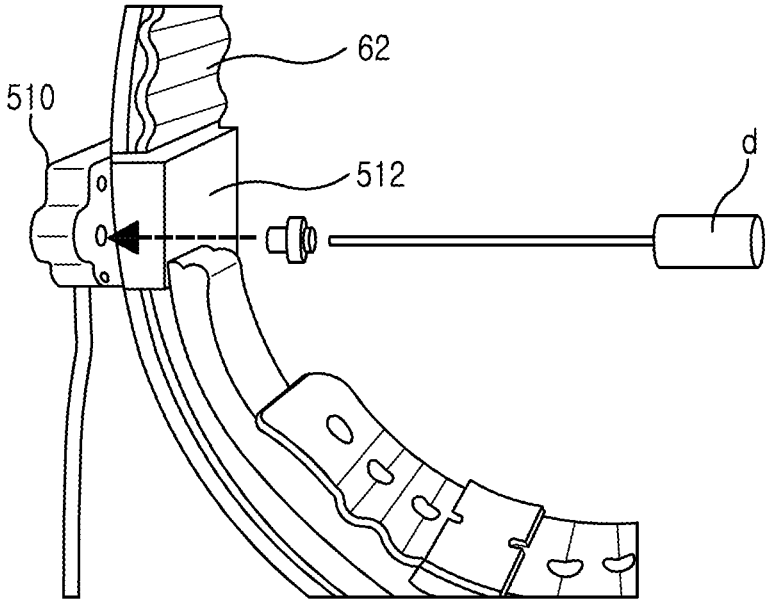

FIGS. 13A to 13C are perspective views sequentially illustrating a process of mounting a band lock in a band strap according to various embodiments of the present disclosure.

Referring to FIGS. 13A to 13C, a band lock includes a band lock body 510 and a band lock cover 512. First, by attaching a double-sided tape to an outer surface of a band strap 62, a mounting position of the band lock 51 is determined. When a mounting position of the band lock body 510 is determined by the double-sided tape, a user may fasten the band lock cover 512 to the attached band lock body 510 using a fastening device, for example, a screw with a driver d.

Figure 14:
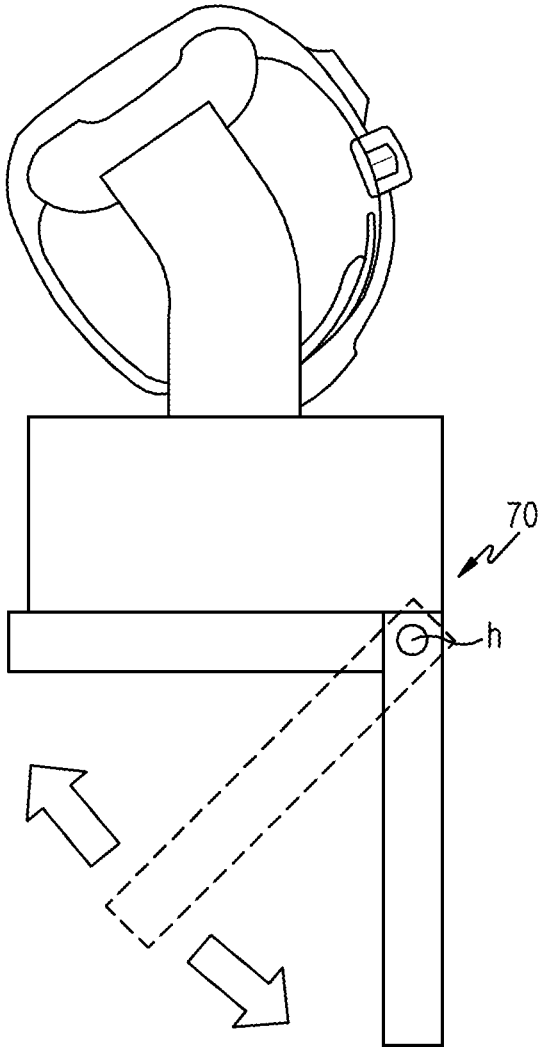
FIG. 14 is a perspective view illustrating a cradle according to an embodiment of the present disclosure.

FIG. 14 is a perspective view illustrating a cradle according to an embodiment of the present disclosure.

Referring to FIG. 14, an angle of a cradle according to an embodiment of the present disclosure may be adjusted by an angle adjustment support 70. The angle adjustment support 70 may have a support rotating by a hinge shaft h. The support may receive a force that maintains an angle by a hinge device.

Figure 15:
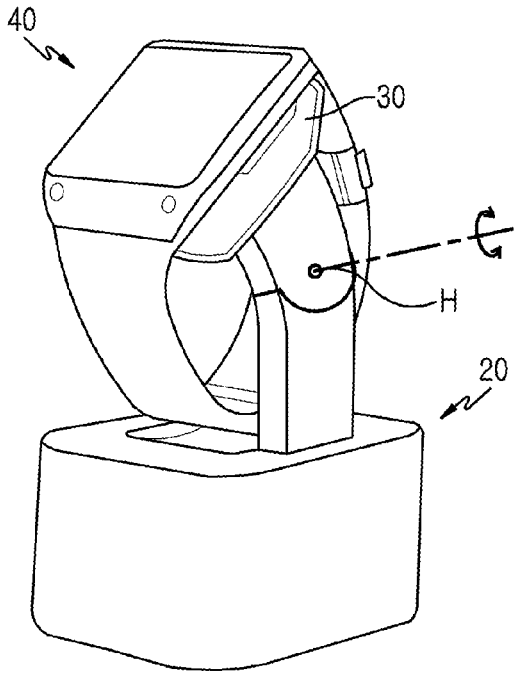
FIG. 15 is a perspective view illustrating a cradle according to an embodiment of the present disclosure.

FIG. 15 is a perspective view illustrating a cradle according to an embodiment of the present disclosure.

Referring to FIG. 15, a cradle according to an embodiment of the present disclosure is formed to rotate a cradle body 20 by a hinge H, and thus the cradle body 20 may rotatably support a cradle head 30. It is preferable that the cradle is disposed in a best visible cradle angle in an exhibit hall.

Additionally, an extension of the cradle body 20 is formed to inwardly recede or to outwardly protrude and thus the height of the cradle head 30 may be adjusted.

Hereinafter, a method of notifying a stolen state of a cradle according to various embodiments of the present disclosure will be described.

Figure 16:
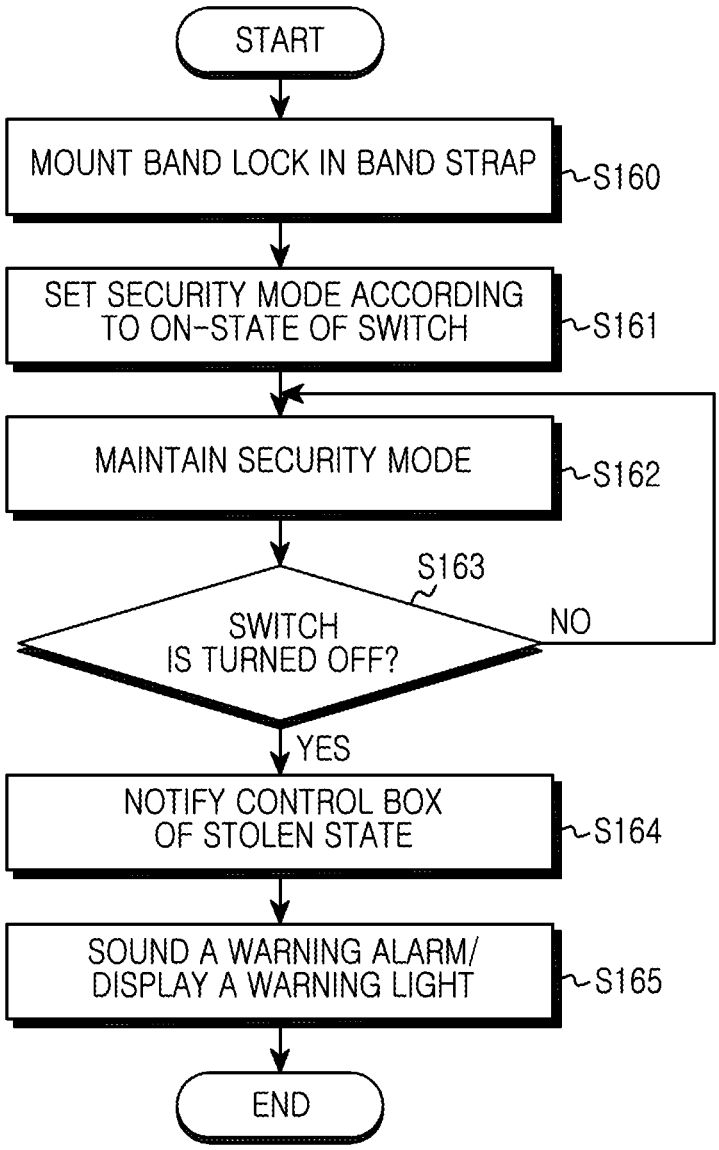
FIG. 16 is a flowchart illustrating a method of warning a stolen state of a cradled wearable device displayed in a cradle according to an embodiment of the present disclosure.

FIG. 16 is a flowchart illustrating a method of warning a stolen state of a wearable device displayed in a cradle according to an embodiment of the present disclosure.

Referring to FIG. 16, when a band lock is mounted in the band strap at operation S160, a switch mounted in the band lock is turned on by pressing the band strap. The control box is set in a security mode according to an on-state of the switch at operation S161.

Thereafter, the cradle maintains a security mode at operation S162. An end portion of the actuator of the switch is pressed by the band strap and maintains an on-state. When the switch is in an on-state, a security mode is maintained in the control box, and when the switch is in an off-state, a security mode is released in the control box and thus a stolen state is determined.

It is determined whether or not the switch is turned off at operation S163. If the switch is not turned off (i.e., NO at operation S163), then the method returns to operation S162, and, if the switch is turned off (i.e., YES at operation S163, where for example, a pressed state of the actuator of the switch is released), then the switch notifies the control box of a stolen state at operation S164.

Thereafter, the control box recognizes a stolen state and audibly or visually notifies a stolen state at operation S165. In a method of audibly notifying a stolen state, a warning alarm may occur by an alarm device provided in the cradle body. In a method of visually notifying a stolen state, a warning light may occur by light emission of LEDs provided in the band lock.

The foregoing constituent elements of an electronic device according to various embodiments of the present disclosure may each be formed with at least one component, and a name of a corresponding constituent element may be changed according to a kind of the electronic device. The electronic device according to various embodiments of the present disclosure may include at least one of the foregoing elements and may omit some elements or may further include additional other elements. Further, when some of elements of the electronic device according to various embodiments of the present disclosure are coupled to form an entity, the entity may equally perform a function of corresponding elements before being coupled.

According to various embodiments of the present disclosure, at least a portion of a device according to the present disclosure may be implemented with an instruction stored at computer-readable storage media in a form of, for example, a programming module. When the instruction is executed by at least one processor, the at least one processor may perform a function corresponding to the instruction. The computer readable storage media may be, for example, a memory. At least a portion of the programming module may be implemented (e.g., executed) by, for example, the processor. At least a portion of the programming module may include, for example, a module, a program, a routine, sets of instructions, or a process for performing at least one function.

The computer-readable storage media may include magnetic media such as a hard disk, a floppy disk, and a magnetic tape, optical media such as a Compact Disc Read Only Memory (CD-ROM) and a Digital Versatile Disc (DVD), magneto-optical media such as a floptical disk, and a hardware device, specially formed to store and perform a program instruction (e.g., a programming module), such as a Read Only Memory (ROM), a Random Access Memory (RAM), a flash memory. Further, a program instruction may include a high-level language code that may be executed by a computer using an interpreter as well as a machine language code generated by a compiler. In order to perform operation of the present disclosure, the above-described hardware device may be formed to operate as at least one software module, and vice versa.

A module or a programming module according to the present disclosure may include at least one of the foregoing constituent elements, may omit some constituent elements, or may further include additional other constituent elements. Operations performed by a module, a programming module, or another constituent element according to the present disclosure may be executed with a sequential, parallel, repeated, or heuristic method. Further, some operations may be executed in different orders, may be omitted, or may add other operations.

As described above, according to various embodiments of the present disclosure, the theft of a wearable device can be prevented, and even when a wearable device is lost, the loss of the wearable device can be simultaneously visually or audibly notified.

Further, according to various embodiments of the present disclosure, because a cradle head can be exchanged, various wearable devices can be supported.

Further, according to various embodiments of the present disclosure, a user can experience a function and a design of a rear surface of the wearable device.

Further, according to various embodiments of the present disclosure, in a wearable device in which a main body and a band strap are separated, the loss of the wearable device can be prevented using a separate bracket.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A cradle, comprising:

a cradle body;

a cradle head that supports a wearable device and is detachable from the cradle body, such that the cradle head is exchangeable; and an anti-theft device that connects the cradle body and the wearable device, wherein the cradle body and the cradle head are electrically connected and are mechanically detachable, and wherein a holding device is provided between the wearable device and the cradle head to receive the wearable device in the cradle head, the holding device providing a magnetic force for holding the wearable device in the cradle head.

2. The cradle of claim 1, wherein the cradle body and the cradle head are electrically connected by a Universal Serial Bus (USB).

3. The cradle of claim 1, wherein the cradle further comprises an adaptor, and wherein the cradle head and the adapter are configured to support wearable devices of various sizes.

4. The cradle of claim 1, wherein the holding device comprises:

a metal material portion provided at a rear surface of the wearable device; and a magnetic body provided in the cradle head.

5. The cradle of claim 1, wherein the cradle head includes a charge terminal configured to charge the wearable device, when the wearable device is supported by the cradle head.

6. The cradle of claim 1, wherein the wearable device comprises:

a main body; and a band strap integrally coupled to the main body and configured to enable the main body to be worn on a wrist.

7. The cradle of claim 6, wherein the anti-theft device comprises:

a band lock fixed to the band strap; and a security cable having one end connected to the cradle body and another end connected to the band lock.

8. The cradle of claim 7, wherein the band lock is fixed to the band strap by a coupling of a band lock body and a band lock cover, and wherein the band lock body comprises:

a substrate;

an optical element disposed at one surface of the substrate and configured to visually notify a charge state or a stolen state; and a switch disposed at another surface of the substrate and configured to enable an actuator to notify a loss state according to whether the band strap is pressed, wherein the actuator is disposed to protrude from an outer surface of the band lock.

9. The cradle of claim 1, wherein the wearable device comprises:

a main body; and a band strap to which the main body is detachable and configured to enable the main body to be worn on a wrist.

10. The cradle of claim 9, wherein a band lock is fixed to the band strap by a coupling of a band lock body and a band lock cover, and wherein the band lock body comprises:

a substrate;

an optical element disposed at one surface of the substrate and configured to visually notify a charge state or a stolen state; and a switch disposed at another surface of the substrate and configured to enable an actuator to notify a loss state according to whether the band strap is pressed, wherein the actuator is disposed to protrude from an outer surface of the band lock.

11. The cradle of claim 9, wherein the anti-theft device comprises:

a band type bracket fixed to enclose a side surface circumference of the main body;

a band lock fixed to the band strap;

a security cable having one end connected to the cradle body and another end connected to the band lock; and a wire having one end fixed to the band lock and another end fixed to the band type bracket.

12. The cradle of claim 11, wherein the band lock is fixed to the band strap by a coupling of a band lock body and a band lock cover, and wherein the band lock body comprises:

a substrate;

an optical element disposed at one surface of the substrate and configured to visually notify a charge state or a stolen state; and a switch disposed at another surface of the substrate and configured to enable an actuator to notify a loss state according to whether the band strap is pressed, wherein the actuator is disposed to protrude from an outer surface of the band lock.

13. The cradle of claim 1, wherein the cradle head includes an adjustable portion that, when attached to the cradle body, is capable of adjusting a viewing angle of the wearable device.

14. A method of notifying a stolen state of a cradled wearable device of a cradle, wherein the cradle comprises:

a wearable device comprising a main body and a band strap coupled to the main body;

a cradle body that supports the wearable device;

a band lock fixed to the band strap;

a switch mounted in the band lock; and a security cable that connects the cradle body and the band lock, and wherein the method comprises:

mounting the band lock in the band strap;

setting a security mode with an operation of the switch mounted in the band lock;

determining whether the wearable device is stolen by determining a stolen state of the wearable device based on the operation of the switch; and visually or audibly notifying the stolen state of the wearable device, when the stolen state is determined.

15. The method of claim 14, wherein the visually or audibly notifying of the stolen state is provided by a path alarm or a warning light.

16. The method of claim 14, wherein the determining of the stolen state according to the operation of the switch comprises determining the stolen state according to a separation or a disconnection of the security cable.

* * * * *